US010839660B2

(12) United States Patent
Correnti

(10) Patent No.: US 10,839,660 B2
(45) **Date of Patent: *Nov. 17, 2020**

(54) OCCUPANCY SIMULATION WITHIN A MONITORED PROPERTY

(71) Applicant: Alarm.com Incorporated, Tysons, VA (US)

(72) Inventor: Matthew Daniel Correnti, Reston, VA (US)

(73) Assignee: Alarm.com Incorporated, Tysons, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/518,090

(22) Filed: Jul. 22, 2019

(65) Prior Publication Data

US 2020/0035080 A1 Jan. 30, 2020

Related U.S. Application Data

(63) Continuation of application No. 15/994,248, filed on May 31, 2018, now Pat. No. 10,360,779.

(Continued)

(51) Int. Cl.

| | |
|---|---|
| ***G08B 25/08*** | (2006.01) |
| ***G08B 15/00*** | (2006.01) |
| *G08B 25/00* | (2006.01) |

(52) U.S. Cl.

CPC ..... *G08B 15/002* (2013.01); *G08B 25/08* (2013.01); *G08B 25/008* (2013.01)

(58) Field of Classification Search

CPC ..... G08B 15/002; G08B 25/008

(Continued)

(56) References Cited

U.S. PATENT DOCUMENTS 6,377,858 B1 4/2002 Koeppe
6,909,921 B1 6/2005 Bilger (Continued)

FOREIGN PATENT DOCUMENTS

WO WO2016/057761 4/2016

OTHER PUBLICATIONS

PCT Notification of Transmittal of the International Search Report and Written Opinion in International Application No. PCT/US 18/35391, dated Aug. 29, 2018, 13 pages.

(Continued)

*Primary Examiner* — Qutbuddin Ghulamali
(74) *Attorney, Agent, or Firm* — Fish & Richardson P.C.

(57) ABSTRACT

A monitoring system includes one or more sensors, one or more connected electronic, and a monitor control unit that is configured to receive sensor data from the one or more sensors, determine usage data that reflects a level of usage of the one or more connected electronic devices, receive occupancy data that reflects an occupancy level of the property, train a predictive model that is configured to determine a likely occupancy level of the property, receive, at a current time and from the one or more sensors, current sensor data, determine, at the current time, current usage data that reflects a current level of usage of the one or more connected electronic devices, apply the current usage data and the current sensor data to the predictive model, determine a likely current occupancy level of the property, determine that the likely current occupancy level of the property is unexpected, and perform an action.

20 Claims, 4 Drawing Sheets

Related U.S. Application Data

(60) Provisional application No. 62/512,879, filed on May 31, 2017.

(58) Field of Classification Search
USPC ..... 340/501
See application file for complete search history.

(56) References Cited

U.S. PATENT DOCUMENTS

| | | | | |
|---|---|---|---|---|
| 8,428,918 | B2 * | 4/2013 | Atrazhev | G06K 9/00778 382/103 |
| 2001/0052862 | A1 * | 12/2001 | Roelofs | G08B 15/002 340/999 |
| 2012/0019353 | A1 | 1/2012 | Knasel | |
| 2012/0276517 | A1 | 11/2012 | Banaszuk et al. | |
| 2015/0112885 | A1 | 4/2015 | Fadell et al. | |
| 2016/0116303 | A1 * | 4/2016 | Rose | G06F 3/0484 702/188 |
| 2016/0189532 | A1 | 6/2016 | Malhotra et al. | |
| 2016/0300474 | A1 * | 10/2016 | Warren | H04L 12/6418 |

OTHER PUBLICATIONS

PCT International Preliminary Report on Patentability in International Application No. PCT/US2018/035391, dated Dec. 12, 2019, 8 pages.

Extended European Search Report in European Application No. 18809908.9, dated Apr. 24, 2020, 9 pages.

* cited by examiner

OCCUPANCY SIMULATION WITHIN A MONITORED PROPERTY

CROSS REFERENCE TO RELATED APPLICATIONS

This application is a continuation of U.S. application Ser. No. 15/994,248, filed May 31, 2018, now allowed, which claims the benefit of U.S. Provisional Application No. 62/512,879, filed May 31, 2017, and titled "Occupancy Simulation within a Monitored Property." Both of these prior applications are incorporated by reference in their entirety.

TECHNICAL FIELD

This disclosure relates to property monitoring technology and, for example, performing occupancy stimulations that mimic human activity within an unoccupied monitored property.

BACKGROUND

Many people equip homes and businesses with monitoring systems to provide increased security for their homes and businesses.

SUMMARY

Techniques are described for monitoring technology. For example, techniques are described for generating models of the human activity within a monitored property based on data collected over a long period of time. The generated models are then used to formulate occupancy simulations which are a series of events that mimic human activity within the unoccupied monitored property. The occupancy simulations may act as a crime deterrent; burglars may believe the unoccupied house is indeed occupied based on observing the activity, and may think twice about attempting to burglarize the property. In this regard, the occupancy simulations add an additional level of security to the monitored property. The occupancy simulations have an advantage over customer designated automations since the models allow for a realistic reflection of the human activity within the home, and the creativity of the generated series of events of the simulations far surpasses the creativity of most users.

According to an innovative aspect of the subject matter described in this application, a monitoring system that is configured to monitor a property, the monitoring system includes one or more sensors that are located at the property and that are configured to generate sensor data, one or more connected electronic devices that are located at the property and that are in communication with a monitor control unit. The monitor control unit is configured to receive sensor data from the one or more sensors, determine usage data that reflects a level of usage of the one or more connected electronic devices, receive occupancy data that reflects an occupancy level of the property, train, using the sensor data, the usage data, and the occupancy data, a predictive model that is configured to determine a likely occupancy level of the property, receive, at a current time and from the one or more sensors, current sensor data, determine, at the current time, current usage data that reflects a current level of usage of the one or more connected electronic devices, apply, to the predictive model, the current usage data and the current sensor data, based on applying the current usage data and the current sensor data to the predictive model, determine a likely current occupancy level of the property, determine that the likely current occupancy level of the property is unexpected, and in response to determining that the likely current occupancy level of the property is unexpected, perform an action of the monitoring system.

These and other implementations each optionally include one or more of the following optional features. The monitor control unit is configured to determine that the likely current occupancy level of the property is unexpected by determining that the property is likely vacant at a time that the property is expected to be occupied, and based on determining that the property is likely vacant at a time that the property is expected to be occupied, perform the action of the monitoring system by providing an instruction to a subset of the one or more connected electronic devices to perform a series of actions that simulate occupancy at the property. The monitor control unit is configured to determine that the likely current occupancy level of the property is unexpected by determining that the property is vacant at a time that the property is expected to be occupied, determine that the monitoring system is in an unarmed state, and based on determining that the monitoring system is in the unarmed state and determining that the property is likely vacant at a time that the property is expected to be occupied, perform the action of the monitoring system by arming the monitoring system and providing an instruction to a subset of the one or more connected electronic devices to perform a series of actions that simulate occupancy at the property, where the subset of the one or more connected electronic devices comprises a first set of one or more connected electronic devices, and where the series of actions that simulate occupancy at the property comprises a first series of actions.

The monitor control unit is configured to determine that the likely current occupancy level of the property is unexpected by determining that the property is vacant at a time that the property is expected to be occupied, determine that the monitoring system is in an armed away state, and based on determining that the likely current occupancy level of the property is unexpected by determining that the property is vacant at a time that the property is expected to be occupied and determining that the monitoring system is in the armed away state, perform the action by providing an instruction to a subset of the one or more connected electronic devices to perform a series of actions that simulate occupancy at the property, where the subset of the one or more connected electronic devices comprises a second set of one or more connected electronic devices, and where the series of actions that simulate occupancy at the property comprises a second series of actions.

The monitor control unit is configured to determine a likely current occupancy level of the property by determining an occupancy level score, comparing the occupancy level score to an occupancy level threshold, and based on comparing the occupancy level score to an occupancy level threshold, determining whether the property is likely vacant or likely occupied. The monitor control unit is further configured to receive, from a user device of a resident of a property, an indication of a selection of one or more connected devices to include in performing a series of actions that simulate occupancy at the property, determine that the likely current occupancy level of the property is unexpected by determining that the property is likely vacant at a time that the property is expected to be occupied, and perform the action of the monitoring system by providing an instruction to a subset of the one or more selected connected devices to perform a series of actions that simulate occupancy at the property based on determining that the property is likely vacant at a time that the that the property is expected to be occupied.

The monitor control unit is further configured to determine an expected energy usage level for performing a first series of actions that simulate occupancy at the property, compare the expected energy usage level for performing a first series of actions that simulate occupancy at the property to an energy consumption threshold, based on comparing the expected energy usage level for performing the first series of actions to an energy consumption threshold, determine that the expected energy usage level for performing the first series of actions exceeds the energy consumption threshold, determine an expected energy usage level for performing a second series of actions that simulate occupancy at the property, compare the expected energy usage level for performing a second series of actions that simulate occupancy at the property to the energy consumption threshold, based on comparing the expected energy usage level for performing the second series of actions to an energy consumption threshold, determine that the expected energy usage level for performing the second series of actions does not exceed the energy consumption threshold, determine that the likely current occupancy level of the property is unexpected by determining that the property is likely vacant at a time that the property is expected to be occupied, and perform the action of the monitoring system by performing the second series of actions that simulate occupancy at the property based on determining that the property is likely vacant at a time that the that the property is expected to be occupied.

The monitor control unit is configured to determine that the likely current occupancy level of the property is unexpected by determining that the property is likely vacant at a time that the property is expected to be occupied, determine the monitoring system is in an armed away state, perform the action of the monitoring system by performing a series of actions that simulate occupancy at the property based on determining that the monitoring system is in an armed away state and determining that the property is likely vacant at a time that the property is expected to be occupied, receive a disarm code to disarm the monitoring system, and based on receiving the disarm code, disarm the monitoring system and end the series of actions that simulate occupancy at the property. The monitor control unit is configured to receive, from a resident, a time range for performing a series of actions that simulate occupancy at the property, determine that the likely current occupancy level of the property is unexpected by determining that the property is likely vacant at a time that the property is expected to be occupied, based on determining that the property is likely vacant at a time that the property is expected to be occupied, compare the current time to the time range for performing the series of actions, determine that the current time is within the time range for performing the series of actions, and perform the action of the monitoring system by, performing the series of actions that simulate occupancy at the property based on determining that the current time is within the time range for performing the series of actions.

The monitor control unit is configured to after performing the series of actions that simulate occupancy at the property, receive occupancy data that indicates the property is occupied, and based on receiving occupancy data that indicates the property is occupied, end the series of actions that simulate occupancy at the property. The monitor control unit is configured to train the predictive model that is configured to determine a likely occupancy level of the property by training the predictive model that is configured to determine the likely occupancy level of the property using sensor data, usage data, the occupancy data from other properties in a same neighborhood as the property. The monitor control unit is configured to train the predictive model that is configured to determine a likely occupancy level of the property by training the predictive model that is configured to determine the likely occupancy level of the property using sensor data, usage data, and occupancy data from other properties that have a same number of residents as the property.

According to another innovative aspect of the subject matter described in this application, a computer-implemented method includes receiving, by a monitoring system that is configured to monitor a property, sensor data from one or more sensors that are located at the property, determining, by the monitoring system, usage data that reflects a level of usage of one or more connected electronic devices that are located at the property, receiving, by the monitoring system, occupancy data that reflects an occupancy level of the property, training, by the monitoring system and using the sensor data, the usage data, and the occupancy data, a predictive model that is configured to determine a likely occupancy level of the property based on given sensor data and given usage data, receiving, by the monitoring system and at a current time and from the one or more sensors, current sensor data, determining, by the monitoring system and at the current time, current usage data that reflects a current level of usage of the one or more connected electronic devices, applying, by the monitoring system and to the predictive model, the current usage data and the current sensor data, based on applying the current usage data and the current sensor data to the predictive model, determining, by the monitoring system, a likely current occupancy level of the property, determining, by the monitoring system, that the likely current occupancy level of the property is unexpected, and in response to determining that the likely current occupancy level of the property is unexpected, performing an action of the monitoring system.

Implementations of the described techniques may include hardware, a method or process implemented at least partially in hardware, or a computer-readable storage medium encoded with executable instructions that, when executed by a processor, perform operations.

The details of one or more implementations are set forth in the accompanying drawings and the description below. Other features will be apparent from the description and drawings, and from the claims.

DETAILED DESCRIPTION

Techniques are described for using occupancy simulations to mimic occupancy at an unattended monitored property. A monitored property may be in communication with a remote cloud server that is configured to receive data from the monitored property over time. The data may include data from sensors, smart devices, appliances, and other connected electronic devices that communicate data to a control unit at the property. Over time, the control unit communicates the collected data to the remote server, the remote server aggregates the data, and generates models that model the human activity within the monitored property. The remote server uses the generated models to formulate occupancy simulations that are similar to the human activity within the property. When the monitored property is unoccupied, the monitoring server commands the control unit to run the occupancy simulations to mimic human activity at the property. For example, the control unit may command a series of lights to switch on, then a television in the master bedroom switching on for thirty minutes, followed by a speaker in the master bath playing music for twenty minutes. The occupancy simulations may act as a crime deterrent; burglars may believe the unoccupied house is indeed occupied based on observing the activity and may think twice about attempting to burglarize the property. In this regard, the occupancy simulations add an additional level of security to the monitored property. The occupancy simulations have an advantage over customer designated automations since the models allow for a realistic reflection of the human activity within the home, and the creativity of the generated series of events of the simulations far surpasses the creativity of most users.

Figure 1:
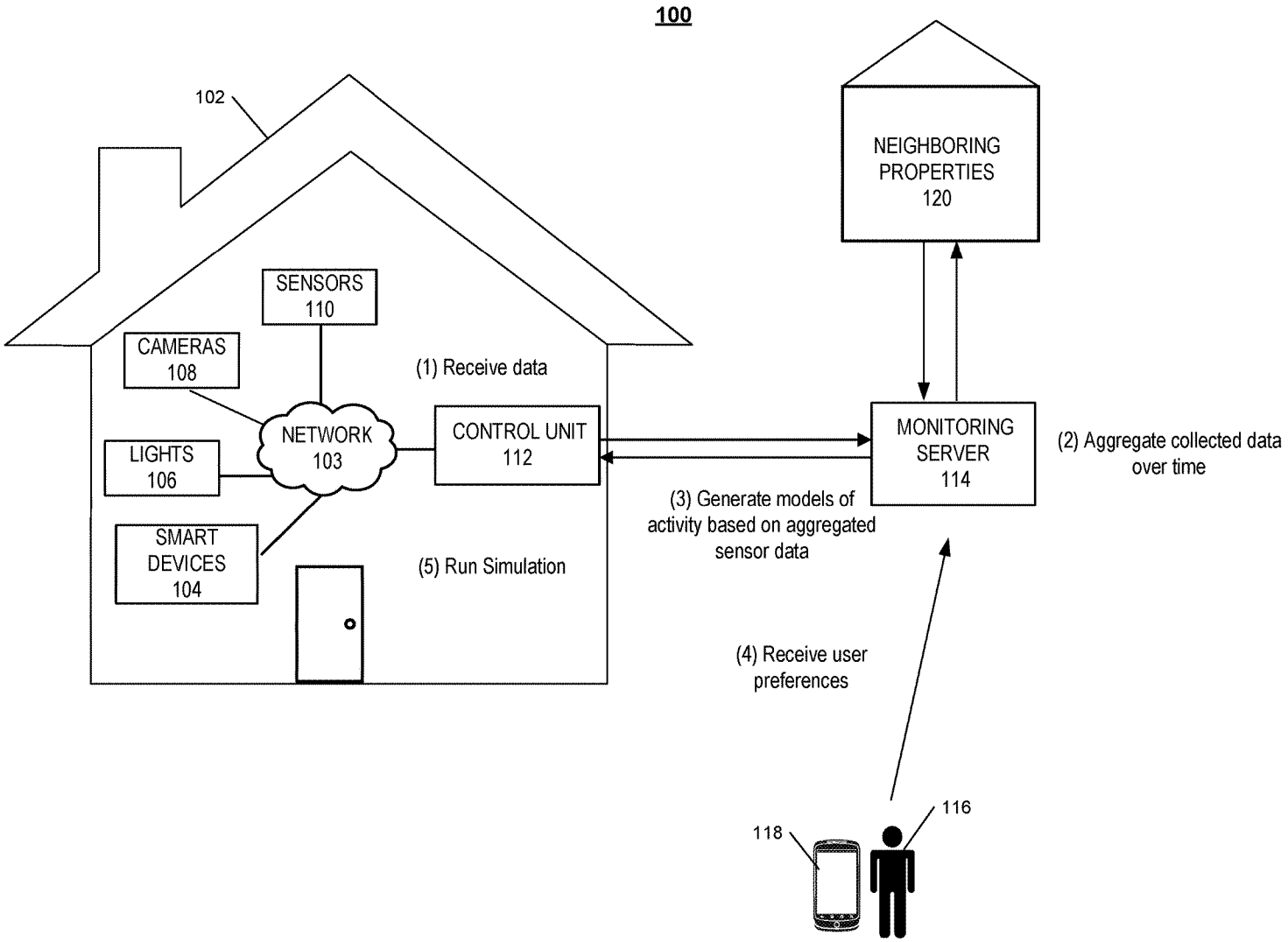
FIG. 1 illustrates an example of a system for running occupancy simulations at a monitored property.

FIG. 1 illustrates an example of a monitoring system 100 that is configured to execute occupancy simulations at an unoccupied monitored property 102. As shown in FIG. 1, a property 102 (e.g. a home) of a user 116 is monitored by an in-home monitoring system (e.g. in-home security system) that includes components that are fixed within the property 102. The in-home monitoring system may include a control unit 112, one or more smart devices 104, one or more sensors 110, and one or more cameras 108. The user 116 may subscribe to an occupancy simulation service to attempt to add additional layer of defense to the in-home monitoring system. The occupancy simulations may help deter burglars from attempting to burglarize an unattended property by simulating realistic human activity.

In the example shown in FIG. 1, the control unit 112 at the monitored property 102 receives data from the one or more connected electronic devices within the monitored property 102. The connected electronic devices include the one or more sensors 110, the one or more cameras 108, the one or more lights 106, and the one or more smart devices 104. The one or more smart devices may be electronic devices that communicate over a network 103 with the control unit 112. For example, a thermostat, a Bluetooth speaker such as Sonos, an entertainment center such as LeGrand, any voice activated device such as Amazon Echo, or Google home, a smart television, a game console, etc. The data received by the control unit 112 reflects the activity within property 102. For example, the control unit 112 may receive data from the one or more lights 106, the data may indicate the presence of an individual during a particular period of time by including the time on and time off for the lights in the kitchen. The lights on time represents when the individual arrives in the kitchen and the lights off time represents when the individual leaves the kitchen.

The control unit 112 may communicate the data received from the connected electronic devices to the monitoring server 114. The monitoring server 114 may be a cloud server that is located remote from the monitored property, and may receive data from one or more other control units. As illustrated in FIG. 1, the monitoring server may communicate with the control units of one or more neighboring homes 120. The monitoring server 114 may collect and aggregate data received from the control unit 112 over a period of time. The period of time may be relatively long and may include data collected over the course of several days, several weeks, several months, and even several years. The aggregated data may include all events sensed by the in-home monitoring system during the period of time, regardless of whether the in-home monitoring system was armed in a manner in which the in-home monitoring system detects alarm conditions when the events occurred. The monitoring server 114 may analyze the aggregated data with other data available to the monitoring server 114, such as location data for the user 116, and, based on the analysis, detects patterns of recurring events within the aggregated data and the other data available to the monitoring server 114. The recurring events may be positive events tied to activity in the property detected by the in-home monitoring system or may be negative events that reflect a lack of activity (or a lack of a particular type of activity) in the property detected by the in-home monitoring system.

The monitoring server 114 may store the detected patterns of activity and use the detected patterns to generate one or more models that capture the daily activities of the users associated with the monitored property 102. The monitoring server 114 may detect events within the property based on events detected by the sensors 110, cameras 108, or smart devices 104 within the property 102. The monitoring server 114 may consider the timing of events, such as events that repeat on a routine basis (e.g., events that occur at the relatively same time everyday day or events that occur at the relatively same time on a particular day of the week). The monitoring server 114 also may consider orders in which events occur (e.g., a particular motion sensor event routinely precedes a particular light on event). The order of events may be considered with respect to timing or irrespective of timing.

To detect patterns within the aggregated data based on the detected patterns, the monitoring server 114 may use any type of data mining techniques capable of detecting patterns of recurring events. The monitoring server 114 may perform an automatic or semi-automatic analysis of relatively large quantities of data to extract previously unknown interesting patterns, such as identifying groups of sensor events using cluster analysis, identifying unusual sensor events using anomaly detection, and identifying dependencies using association rule mining. Based on the patterns detected, the monitoring server 114 may assign a confidence score for each pattern that reflects a likelihood that the detected pattern is actually a pattern of recurring events that will be observed in the future based on user habits. The monitoring server 114 may determine the confidence score based on a percentage of time the pattern has occurred in the past, the amount of data used in detecting the pattern, and any statistical techniques that assess whether the pattern is a statistically significant pattern of recurring events. The monitoring server 114 may use the detected patterns to generate models which may be used to generate simulation patterns. For example, a detected pattern may include a front door contact sensor event, followed by one or more lights on events, followed by a speaker on event.

The monitoring server 114 may receive user preferences from the user 116. The user device 122 may include a native home monitoring application that allows the user to set customized preferences for the control and automation of the home monitoring system. The monitoring server 114 may be associated with a native monitoring application that runs on a user device 122. The user may set preferences through the native monitoring application on the user's device 122, and the monitoring sever 114 may store data associated with user set preferences. The user 116 may enroll in the occupancy simulations feature through the application, and the user may identify devices within the home that should or should not be included in the simulations. For example, the user may opt out of including televisions to switch on as one of the events within simulations. In some implementations the monitoring server may generate the occupancy simulations based on energy saving guidelines. For example, the user may select an energy efficiency option through the home monitoring application. Based on selecting this preference, the monitoring server 114 may generate occupancy simulations that do not utilize connected devices with a power consumption over a set threshold. For example, the generated simulations may not include switching on smart televisions but may include activating a speaker device.

The monitoring server 114 communicates instructions to the control unit 112 to initiate the occupancy simulations. The monitoring server 114 may communicate the instructions to the control unit 112 based on the received user preferences and the generated human activity models. The monitoring server 114 may communicate to the control unit 112 based unexpected or expected occupancy at the monitored property. In some implementations, the user 116 may have the ability to schedule a time for a simulation to begin. For example, the user 116 may decide to schedule simulations to begin every week day at 5:30 pm in cases where the monitored property is vacant. In another example, the user 116 may decide to initiate a simulation each time the control unit 112 detects that the property 102 is unoccupied.

In some implementations, the occupancy simulations may be initiated when the control unit 112 detects an unexpected vacancy at the monitored property. The monitoring server 114 may detect vacancy patters associated with the human activity at the monitored property. For example, the monitoring server 114 may detect that the front door is opened every week day morning at 8:30 AM followed by no activity with the property until the front door is opened at 6:30 PM followed by detected activity within the property. Based on this sequence of activity, the monitoring server 114 may determine that the property 102 is unoccupied during week days between the hours of 8:30 AM and 6:30 PM. When the monitoring server 114 detects a period of vacancy that is not typical based on the detected patterns, the monitoring server 114 may prompt the control unit 112 to run an occupancy simulation. For example, the user may work late on a Wednesday night, and the monitoring server 114 may determine that the house is still vacant at 6:45 PM and may prompt the control unit to initiate an occupancy simulation.

The control unit 112 communicates with the one or more sensors 110, cameras 108, lights 106, smart devices 104 throughout the monitored property 102 to perform the occupancy simulation. The occupancy simulation may be a simulation sequence selected from one or more simulation sequences stored at the monitoring server 114. The occupancy simulations may vary over time since the simulations provide a realistic reflection of the human activity within the home. As the monitoring server 114 collects and aggregates more and more data over time, the generated models of human activity within the property 102 are updated, and in turn the generated occupancy simulations are updated to reflect the change in human behavior. The creativity of the occupancy simulations is beyond the capability of schedules created by users since the models are based on the actual human activity within the property. A typical user set schedules may include turning on a particular light or series of lights, but since the same series of lights may be activated with each vacancy, prospective burglars may easily identify the common pattern. Even if the on and off times for the lights vary in user set schedules, or are randomized, the particular lights involved in the schedule is static making it easy for burglars to identify a pattern. In some implementations, one or more occupancy simulations are executed until the monitored property is occupied. In other implementations, the monitoring server may not repeat an exact occupancy simulation pattern.

In some implementations, when the control unit 112 detects periods of little to no activity within the monitored property 102, the monitoring server 114 may communicate to the control unit 112 to initialize an occupancy simulation. The control unit 112 may run occupancy simulations when the users associated with the property 102 are within the property but are inactive, for example, when the users may be asleep within the property. In some examples, when a threshold period of time has elapsed without the control unit 112 detecting activity within the property while the property is occupied, the monitoring server commands the control unit to initialize an occupancy simulation. Simulating occupancy at the property while the users are asleep may help to deter crime since many burglaries occur while the residents of the property are asleep. In other examples, the user may select to turn on an option to run occupancy simulations before going to bed. In these examples, the occupancy simulations that are executed may include a subset of the devices within the property. For example, the simulation may not include any devices that produce audible sounds that may wake the users.

The monitoring server 114 may be configured to distinguish the activity generated by the occupancy simulations from the customer initiated activity within the property 102. In some implementations, the monitoring server 114 may flag the events that are generated as an occupancy simulation so that server 114 does not collect and aggregate such data.

The monitoring server 114 may be in communication with one or more control units associated with one or more other properties. As illustrated in FIG. 1, the one or more other properties may be neighboring properties 120. The data received at the monitoring server 114 from each of the one or more properties may be used to generate the models of human activity for each of the respective properties. In some examples, where the monitoring server 114 does not have enough data from the control unit 112 associated with the monitored property 102 to generate models of the human activity, and to generate occupancy simulations for the property 102, the monitoring server 114 may access data associated with the one or more other properties. Over time, as the monitoring server collects more and more data from the monitored property, the monitoring server 114 may aggregate the data to generate the human activity models.

In some implementations, the monitoring server 114 may use the data received from one or more monitored properties within a particular neighborhood to engender a network effect amongst the neighboring monitored properties 120. The occupancy simulation feature of the monitoring system at each of the monitored properties may more effectively deter crime within a neighborhood by generating occupancy simulations within each of the one or more unoccupied properties, that is, the more homes that appear to be occupied, the more effective this feature is to deter crime in the neighborhood The monitoring server 114 may determine that one or more properties within the neighborhood are unoccupied, and determine to run occupancy simulations within at least a subset of the unoccupied homes. The monitoring server 114 may generate an occupancy simulation for a property based on the human activity within the property, and may communicate the simulation sequence to control unit of the property.

For example, five properties on a street within a neighborhood may be enrolled in an occupancy simulations feature of a monitoring system, and each property may be in communication with the monitoring server 114. When the control units at each of the five properties detects vacancy and communicates the detected vacancy to the monitoring server 114, the monitoring server 114 may initialize occupancy simulations within four of the five vacant properties. In some implementations, the monitoring server 114 may initialize the occupancy simulations at the same time at each property. In other implementations, the monitoring server 114 may initialize the occupancy simulations at each of the homes based on the order the vacancy was determined. In some examples, the monitoring server 114 may communicate an occupancy simulation to each of the five vacant homes. In some examples, the monitoring server 114 may initialize an occupancy simulation at two of the five properties, and when the simulation those two simulations are complete, initialize an occupancy simulation at the other three properties. Since each of the occupancy simulations are generated based on the human activity within each property, the generated simulations are not identical.

The control unit at the monitored property 102 may be prompted to initiate an occupancy simulation based on a sensor, camera, or other device detecting a simulation event. For example, a camera may detect an unknown person in the yard of the monitored property, based on the camera detecting an unknown person, the control unit may turn on a light in the living room followed by switching on the television for thirty minutes. In some examples, activity detected by one or more sensors or devices of neighboring homes may prompt an occupancy simulation. For example, when a camera of one of the neighboring homes detects an unknown person in the yard, the controls units of each of the other homes may either run an occupancy simulation or make changes to an occupancy simulation currently being run. In some implementations, when an alarm condition is detected by the control unit of one of the neighboring homes, the control units of the other homes may each run an occupancy simulation. For example, if a contact sensor is tripped at one home and the control unit generates an alarm, the control units at the one or more other neighboring homes may initialize occupancy simulations to deter the burglars from attempting to burglarize another home.

Figure 2:
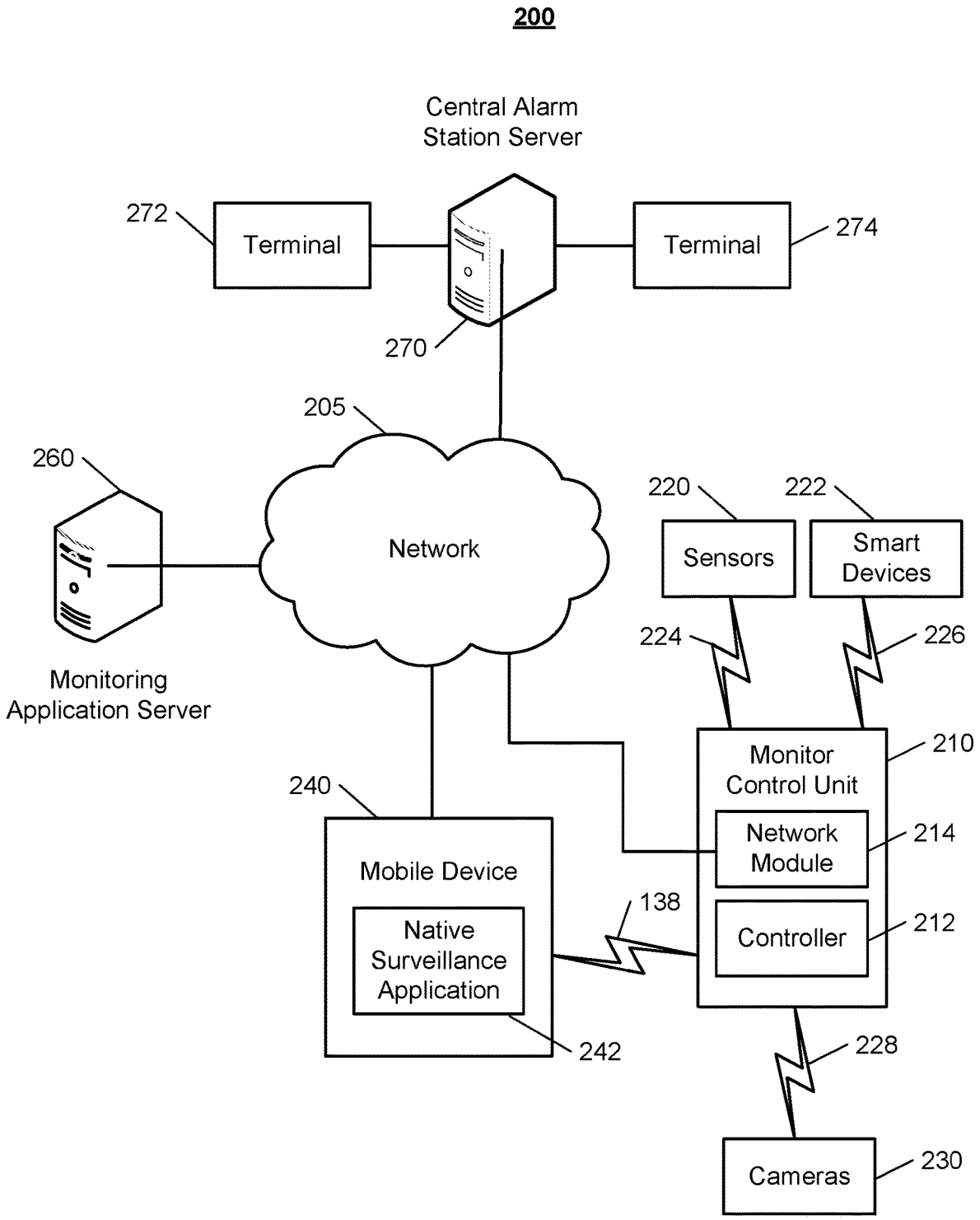
FIG. 2 illustrates an example of a monitoring system integrated with sensors, cameras and smart devices.

FIG. 2 illustrates an example of a system 200 configured to monitor a property. The system 200 includes a network 205, a monitoring system control unit 210, one or more user devices 240, a monitoring application server 260, and a central alarm station server 270. The network 205 facilitates communications between the monitoring system control unit 210, the one or more user devices 240, the monitoring application server 260, and the central alarm station server 270. The network 205 is configured to enable exchange of electronic communications between devices connected to the network 205. For example, the network 205 may be configured to enable exchange of electronic communications between the monitoring system control unit 210, the one or more user devices 240, the monitoring application server 260, and the central alarm station server 270. The network 205 may include, for example, one or more of the Internet, Wide Area Networks (WANs), Local Area Networks (LANs), analog or digital wired and wireless telephone networks (e.g., a public switched telephone network (PSTN), Integrated Services Digital Network (ISDN), a cellular network, and Digital Subscriber Line (DSL)), radio, television, cable, satellite, or any other delivery or tunneling mechanism for carrying data.

Network 205 may include multiple networks or subnetworks, each of which may include, for example, a wired or wireless data pathway. The network 205 may include a circuit-switched network, a packet-switched data network, or any other network able to carry electronic communications (e.g., data or voice communications). For example, the network 205 may include networks based on the Internet protocol (IP), asynchronous transfer mode (ATM), the PSTN, packet-switched networks based on IP, X.25, or Frame Relay, or other comparable technologies and may support voice using, for example, VoIP, or other comparable protocols used for voice communications. The network 205 may include one or more networks that include wireless data channels and wireless voice channels. The network 205 may be a wireless network, a broadband network, or a combination of networks including a wireless network and a broadband network.

The monitoring system control unit 210 includes a controller 212 and a network module 214. The controller 212 is configured to control a monitoring system (e.g., a home alarm or security system) that includes the monitor control unit 210. In some examples, the controller 212 may include a processor or other control circuitry configured to execute instructions of a program that controls operation of an alarm system. In these examples, the controller 212 may be configured to receive input from indoor door knobs, sensors, detectors, or other devices included in the alarm system and control operations of devices included in the alarm system or other household devices (e.g., a thermostat, an appliance, lights, etc.). For example, the controller 212 may be configured to control operation of the network module 214 included in the monitoring system control unit 210.

The network module 214 is a communication device configured to exchange communications over the network 205. The network module 214 may be a wireless communication module configured to exchange wireless communications over the network 205. For example, the network module 214 may be a wireless communication device configured to exchange communications over a wireless data channel and a wireless voice channel. In this example, the network module 214 may transmit alarm data over a wireless data channel and establish a two-way voice communication session over a wireless voice channel. The wireless communication device may include one or more of a GSM module, a radio modem, cellular transmission module, or any type of module configured to exchange communications in one of the following formats: LTE, GSM or GPRS, CDMA, EDGE or EGPRS, EV-DO or EVDO, UMTS, or IP.

The network module 214 also may be a wired communication module configured to exchange communications over the network 205 using a wired connection. For instance, the network module 214 may be a modem, a network interface card, or another type of network interface device. The network module 214 may be an Ethernet network card configured to enable the monitoring control unit 210 to communicate over a local area network and/or the Internet. The network module 214 also may be a voiceband modem configured to enable the alarm panel to communicate over the telephone lines of Plain Old Telephone Systems (POTS).

The monitoring system may include multiple sensors 220. The sensors 220 may include a contact sensor, a motion sensor, a glass break sensor, or any other type of sensor included in an alarm system or security system. The sensors 220 also may include an environmental sensor, such as a temperature sensor, a water sensor, a rain sensor, a wind sensor, a light sensor, a smoke detector, a carbon monoxide detector, an air quality sensor, etc. The sensors 220 further may include a health monitoring sensor, such as a prescription bottle sensor that monitors taking of prescriptions, a blood pressure sensor, a blood sugar sensor, a bed mat configured to sense presence of liquid (e.g., bodily fluids) on the bed mat, etc. In some examples, the sensors 220 may include a radio-frequency identification (RFID) sensor that identifies a particular article that includes a pre-assigned RFID tag.

The monitoring system may include one or more smart devices 222. The one or more smart devices 222 may include a thermostat, a speaker, a television, a game console, a water heater, or any suitable household device. The one or more smart devices 222 communicate with the monitor control unit 210 via communication link 226.

The monitoring system may include one or more cameras 230. The one or more cameras 230 may be a video/photographic camera or other type of optical sensing device configured to capture images. For instance, the one or more cameras 230 may be configured to capture images of an area within a building monitored by the monitor control unit 210. The one or more cameras 230 may be configured to capture single, static images of the area and also video images of the area in which multiple images of the area are captured at a relatively high frequency (e.g., thirty images per second). The one or more cameras 230 may be controlled based on commands received from the monitor control unit 210.

The one or more cameras 230 may be triggered by several different types of techniques. For instance, a Passive Infra Red (PIR) motion sensor may be built into the one or more cameras 230 and used to trigger the one or more cameras 230 to capture one or more images when motion is detected. The one or more cameras 230 also may include a microwave motion sensor built into the camera and used to trigger the camera to capture one or more images when motion is detected. Each of the one or more cameras 230 may have a "normally open" or "normally closed" digital input that can trigger capture of one or more images when external sensors (e.g., the sensors 220, PIR, door/window, etc.) detect motion or other events. In some implementations, at least one camera 230 receives a command to capture an image when external devices detect motion or another potential alarm event. The camera may receive the command from the controller 212 or directly from one of the sensors 220. In some examples, the one or more cameras 230 triggers integrated or external illuminators (e.g., Infra Red, Z-wave controlled "white" lights, lights controlled by the module 214, etc.) to improve image quality when the scene is dark. An integrated or separate light sensor may be used to determine if illumination is desired and may result in increased image quality.

The sensors 220, the devices 222, and the cameras 230 communicate with the controller 212 over communication links 224, 226, and 228. The communication links 224, 226, and 228 may be a wired or wireless data pathway configured to transmit signals from the sensors 220, the devices 222, and the cameras 230 to the controller 212. The communication link 224, 226, and 228 may include a local network, such as, 802.11 "Wi-Fi" wireless Ethernet (e.g., using low-power Wi-Fi chipsets), Z-Wave, Power Over Ethernet (POE), Zigbee, Bluetooth, "HomePlug" or other Powerline networks that operate over AC wiring, and a Category 5 (CAT5) or Category 6 (CAT6) wired Ethernet network.

The monitoring application server 260 is an electronic device configured to provide monitoring services by exchanging electronic communications with the monitor control unit 210, and the one or more user devices 240, over the network 205. For example, the monitoring application server 260 may be configured to monitor events (e.g., alarm events) generated by the monitor control unit 210. In this example, the monitoring application server 260 may exchange electronic communications with the network module 214 included in the monitoring system control unit 210 to receive information regarding events (e.g., alarm events) detected by the monitoring system control unit 210. The monitoring application server 260 also may receive information regarding events (e.g., alarm events) from the one or more user devices 240.

The one or more user devices 240 are devices that host and display user interfaces. The user device 240 may be a cellular phone or a non-cellular locally networked device with a display. The user device 240 may include a cell phone, a smart phone, a tablet PC, a personal digital assistant ("PDA"), or any other portable device configured to communicate over a network and display information. For example, implementations may also include Blackberry-type devices (e.g., as provided by Research in Motion), electronic organizers, iPhone-type devices (e.g., as provided by Apple), iPod devices (e.g., as provided by Apple) or other portable music players, other communication devices, and handheld or portable electronic devices for gaming, communications, and/or data organization. The user device 240 may perform functions unrelated to the monitoring system, such as placing personal telephone calls, playing music, playing video, displaying pictures, browsing the Internet, maintaining an electronic calendar, etc.

The user device 240 includes a monitoring application 242. The monitoring application 242 refers to a software/firmware program running on the corresponding mobile device that enables the user interface and features described throughout. The user device 240 may load or install the monitoring application 242 based on data received over a network or data received from local media. The monitoring application 242 runs on mobile devices platforms, such as iPhone, iPod touch, Blackberry, Google Android, Windows Mobile, etc.

The central alarm station server 270 is an electronic device configured to provide alarm monitoring service by exchanging communications with the monitor control unit 210, the one or more user devices 240, and the monitoring application server 260 over the network 205. For example, the central alarm station server 270 may be configured to monitor alarm events generated by the monitoring system control unit 210. In this example, the central alarm station server 270 may exchange communications with the network module 214 included in the monitor control unit 210 to receive information regarding alarm events detected by the monitor control unit 210. The central alarm station server 270 also may receive information regarding alarm events from the one or more user devices 240.

The central alarm station server 270 is connected to multiple terminals 272 and 274. The terminals 272 and 274 may be used by operators to process alarm events. For example, the central alarm station server 270 may route alarm data to the terminals 272 and 274 to enable an operator to process the alarm data. The terminals 272 and 274 may include general-purpose computers (e.g., desktop personal computers, workstations, or laptop computers) that are configured to receive alarm data from a server in the central alarm station server 270 and render a display of information based on the alarm data. For instance, the controller 212 may control the network module 214 to transmit, to the central alarm station server 270, alarm data indicating that a sensor 220 detected a door opening when the monitoring system was armed. The central alarm station server 270 may receive the alarm data and route the alarm data to the terminal 272 for processing by an operator associated with the terminal 272. The terminal 272 may render a display to the operator that includes information associated with the alarm event (e.g., the name of the user of the alarm system, the address of the building the alarm system is monitoring, the type of alarm event, etc.) and the operator may handle the alarm event based on the displayed information.

In some implementations, the terminals 272 and 274 may be mobile devices or devices designed for a specific function. Although FIG. 2 illustrates two terminals for brevity, actual implementations may include more (and, perhaps, many more) terminals. In some implementations, the one or more user devices 240 communicate with and receive monitoring system data from the monitor control unit 210 using the communication link 238. For instance, the one or more user devices 240 may communicate with the monitor control unit 210 using various local wireless protocols such as Wi-Fi, Bolt, Lora, Bluetooth, Z-Wave, Zigbee, "HomePlug," or other Powerline networks that operate over AC wiring, or Power over Ethernet (POE), or wired protocols such as Ethernet and USB, to connect the one or more user devices 240 to local security and automation equipment. The one or more user devices 240 may connect locally to the monitoring system and its sensors and other devices. The local connection may improve the speed of status and control communications because communicating through the network 205 with a remote server (e.g., the monitoring application server 260) may be significantly slower.

Although the one or more user devices 240 are shown as communicating with the monitor control unit 210, the one or more user devices 240 may communicate directly with the sensors and other devices controlled by the monitor control unit 210. In some implementations, the one or more user devices 240 replace the monitoring system control unit 210 and perform the functions of the monitoring system control unit 210 for local monitoring and long range/offsite communication.

Figure 3:
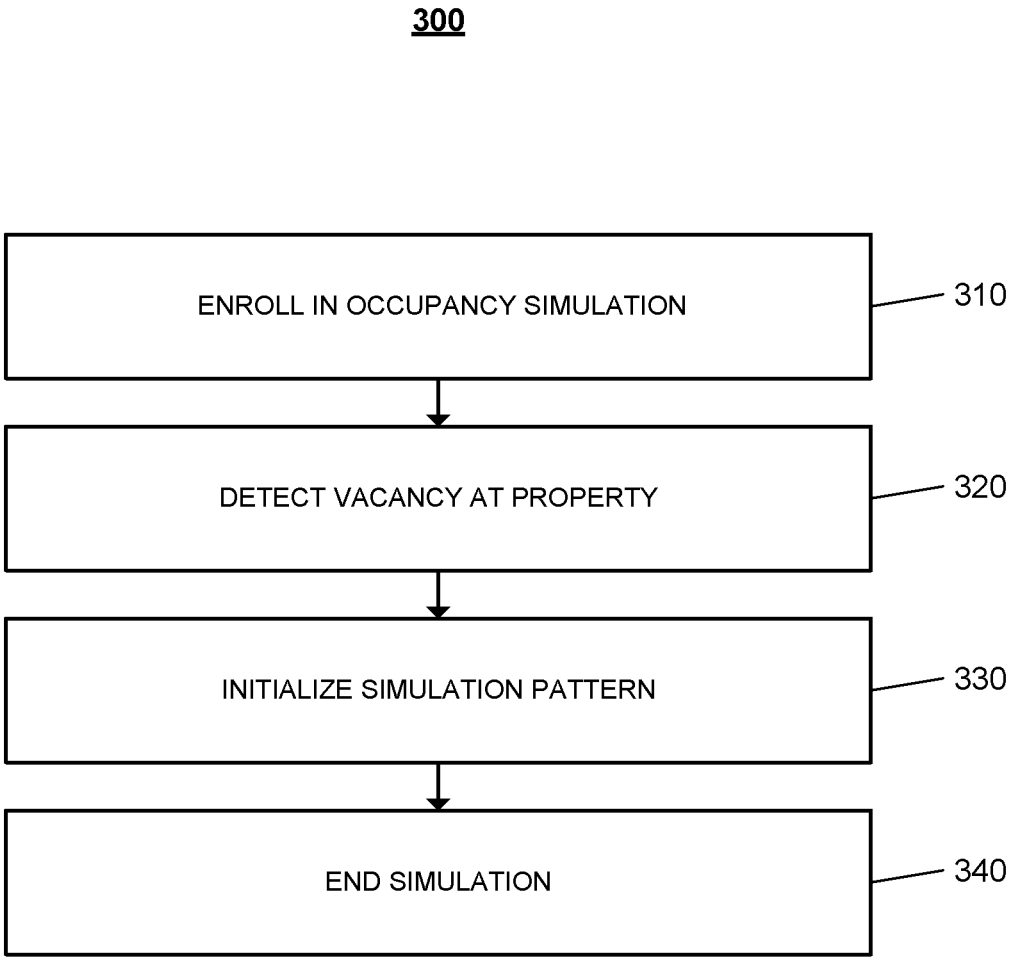
FIG. 3 is a flow chart of an example process for ending an occupancy simulation.

FIG. 3 illustrates an example process 300 for ending an occupancy simulation at a monitored property. The user enrolls in an occupancy simulation service (310). The user may be a user associated with a property monitored by a home monitoring system. The user may access a home monitoring application on the user device to opt into the occupancy simulations feature. The home monitoring application may be maintained by a backend server that receives data from the one or more sensors and smart appliances/devices at the monitored property. The backend server receives data from sensors, lights, and other smart devices, and aggregates the data received over time to generate models of human activity within the monitored property. The generated models are then used by the backend server to generate occupancy simulations. The generated occupancy simulations may be used to mimic the human activity at the monitored property at times of vacancy. The user may set preferences for the execution of the occupancy simulations at the monitored property through the monitoring application. The user set preferences may be stored at the backend server, and may include set schedules for an initiation of an occupancy simulation, and/or selecting which devices should be included in the simulation events.

The monitoring server detects vacancy at the monitored property (320). The control unit at the monitored property receives data from the one or more sensors, lights, cameras, and other smart devices within the monitored property. When the control unit communicates the data received from the devices to the backend server, the backend server may identify patterns within the data that indicates that the property is vacant. For example, the data may include data from a contact sensor on the garage door indicating that the garage door open and closed followed by a period of time when no data was received from any of the one or more motion sensors within the property. The backend server may determine that this series of events indicates that the monitored property is vacant. The backend server may determine expected periods of vacancy based on the patterns of human activity at the property. For example, the backend server may determine that the house is vacant between 8:00 AM and 6:00 PM during week days.

The monitoring server initializes the occupancy simulation pattern (330). The backend server may store in memory one or more occupancy simulations patterns that are generated based on the models of human activity at the monitored property. The backend server may select a pattern to execute and may communicate the instructions to the control unit. The control unit at the monitored property is in communication with the connected devices, and may communicate with each of the one or more devices included in the simulation. For example, the control unit may command the lights to turn on in the property in a sequence leading to the master bedroom, followed by a playing an hour long playlist on a connected speaker. In some examples the occupancy simulation begins immediately when the backend server detects a vacancy at the property. In other examples, the occupancy simulation begins after a threshold period of time after detecting vacancy. For example, the occupancy simulation begins thirty minutes after detecting vacancy.

The monitoring server ends the occupancy simulation (340). The monitoring server may end the occupancy simulation when it detects activity at the property. For example, the control unit at the monitored property may receive data from one or more motion detectors within the home detecting motion, and may communicate the data to the backend server. The backend server may end the simulation and return the devices and or sensors to their original state. For example, when the backend server detects human activity at the property while playing music from a speaker, the backend server communicates with the control unit to command the speaker to stop playing music. In some implementations, the backend server may end the occupancy simulation when the monitoring system at the property is disarmed. For example, the user may arrive at home and enter a valid code to disarm the system, the control unit may communicate this data to the backend server which in turn commands the control unit to command the end of the simulation. An occupancy simulation may be ended at the end of the sequence of events. In some examples, when the control unit still detects vacancy at the end of an occupancy simulation, the monitoring server may initialize a second occupancy simulation. In other examples, when the control unit still detects vacancy at the end of an occupancy simulation, the monitoring server may re-initialize the same occupancy simulation. In these examples, the occupancy simulation may loop until the control unit detects human activity at the property.

The control unit may be configured to end an occupancy simulation when the simulation has been running for over a threshold period of time without the detection of human activity within the property. For example, the user may be out all night and instead of the simulations running throughout the night, the simulations are ended if human activity is not detected after three hours of running simulations. The simulation may be ended by a series of events that mimic the user going to bed. The series of events that end the simulation may vary over time, and in some examples the threshold period of time for the ending of the simulation varies, for instance, the simulations may be ended after four hours, in other instances, after five hours. In some examples, if the control unit does not detect human activity by a particular time then the control unit would end the simulation. For example, if no activity is detected by 11:00 PM, the control unit ends the simulation. The sequence of events that end a simulation may vary each time, and may differ in length to ensure that potential burglars cannot determine a pattern.

Figure 4:
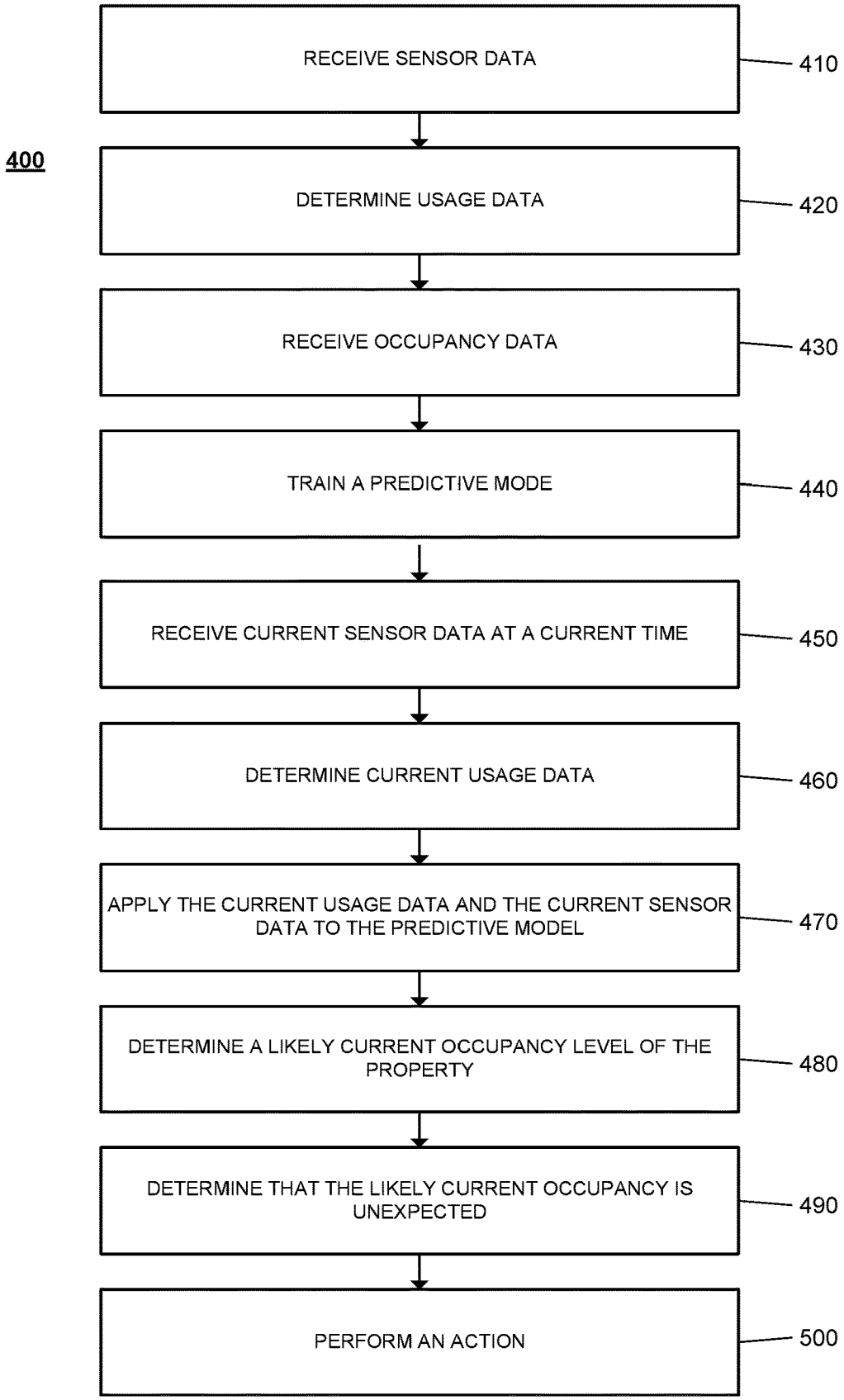
FIG. 4 is a flow chart of an example process for performing an action of the monitoring system

FIG. 4 illustrates an example process for performing an action at a monitored property. A property may be monitored by a monitoring system that is managed by a monitor control unit. The monitor control unit may be in communication with an external monitoring server. The monitor control unit may be in communication with one or more sensors, one or more smart devices, one or more appliances, and other connected electronic devices located throughout the monitored property. The monitor control unit receives sensor data from one or more sensors (410). The one or more sensors may include motion sensors, contact sensors, temperature sensors, or any other suitable sensor that is located at the property. The one or more sensors may communicate with the control unit over a network. The sensor data received by the monitor control unit may include data that identifies the sensor that transmitted the sensor data. For example, the monitor control unit may receive contact sensor data from a window in the master bedroom indicating that the window is opened. The sensor data may also be timestamped. For example, the monitor control unit may receive sensor data from a motion sensor indicating that motion occurred in the kitchen at 6:00 PM on Monday June 20. The monitor control unit may receive sensor data from a sensor when the sensor senses a change. For example, the monitor control unit may receive data from a motion sensor when motion is detected. The monitor control unit may receive sensor data from a sensor on a periodic basis. For example, the monitor control unit may receive sensor data from a motion sensor every hour. In some implementations, the monitor control unit communicates the sensor data received from one or more sensors to the monitoring server to be processed by the server.

The monitor control unit determines usage data that reflects a level of usage of one or more connected electronic devices (420). The monitor control unit may be in communication with one or more connected electronic devices, such as, a smart device, an appliance, or other suitable connected electronic devices. For example, the monitor control unit may be in communication with a smart speaker. The monitor control unit may receive data from the one or more connected devices located throughout the monitored property. The data received from the one or more connected devices may be timestamped. A connected electronic device may communicate with the monitor control unit when the device is powered on, and the monitor control unit may determine when the connected device is powered off. For example, a Sonos Bluetooth speaker communicates with the monitor control unit with the speaker is powered on. The monitor control unit determines a level of usage associated with each of the one or more connected electronic devices based on the on and off data received from each device.

The monitor control unit receives occupancy data that reflects an occupancy level of the property (430). The monitor control unit may receive data from one or more motion detectors located throughout the property. In some examples, the monitor control unit may receive location data from the user devices of the residents of the monitored property. In these examples, the monitor control unit may determine the occupancy of the property based on the location of the user devices along with the motion sensor data. In some implementations, the monitor control unit may be configured to request feedback from the resident to confirm the location of the resident. For example, when the monitor control unit receives data from one or more motion sensor indicating motion at the property, and may send a request for feedback to the user device of the resident. The resident may receive the request for feedback and indicate whether the resident was at the property at the time the motion was detected, or whether the resident was not at the property. In some implementations, the monitor control unit may be configured to request feedback from the resident when the control unit determines that the resident's user device is connected to the wireless network at the property. In other implementations, the monitor control unit may be configured to periodically request location confirmation data from the resident.

The monitor control unit trains a predictive model that is configured to determine a likely occupancy level of the property using the sensor data, the usage data, and the occupancy data (440). In some implementations, the predictive model may be trained using machine learning techniques. The predictive model may be a neural network, the monitor control unit may train the predictive model based on identifying reoccurring events in the sensor data, the usage data, and the occupancy data collected over time. The monitor control unit may collect and aggregate data received over the course of a several days, several weeks, several months, and several years. In some implementations, the sensor data, the usage data, and the occupancy data received over time by the monitor control unit is communicated to a monitoring server that aggregates the data and identifies reoccurring events in the data. In these implementations, the monitoring server trains the predictive model. In some implementations, the monitor control unit may be configured to use a rule method to determine when to run an occupancy simulation, and which occupancy simulation should be run. For example, the monitor control unit may perform a first series of actions when the monitor control unit determines the property is vacant at 6:00 PM when the property is expected to be occupied. For another example, the monitor control unit may perform a second series of actions when the monitor control unit determines the property is vacant at 9:00 PM when the property is expected to be occupied. The second series of actions may include a simulation that mimics the resident preparing off and retiring to bed. For example, the monitor control unit may switch on a series of light leading to the master bedroom, switching of the lights that were switched on, followed by switching on the television in the master bedroom for 30 minutes, and then switching off the television.

The monitor control unit may analyze sensor data, the usage data, and the occupancy data using any type of data mining techniques to detect the patterns of recurring events. The monitor control unit may perform an automatic or semi-automatic analysis of relatively large quantities of data to extract previously unknown interesting patterns, such as identifying groups of sensor events using cluster analysis, identifying unusual sensor events using anomaly detection, and identifying dependencies using association rule mining. Based on the patterns detected, the monitor control unit may assign a confidence score for each pattern that reflects a likelihood that the detected pattern is actually a pattern of recurring events that will be observed in the future based on user habits. The monitor control unit may determine the confidence score based on a percentage of time the pattern has occurred in the past, the amount of data used in detecting the pattern, and any statistical techniques that assess whether the pattern is a statistically significant pattern of recurring events. The monitor control unit may use the detected patterns to train the predictive model.

The monitor control unit receives current sensor data from one or more sensors at a current time (450). The monitor control unit determines, at the current time, current usage data that reflects a current level of usage of the one or more connects electronic devices. (460). The monitor control unit applies the current usage data and the current sensor data to the predictive model (470). The monitor control unit uses the predictive model to generate a score for the received sensor data and the usage data, and based on comparing the generated score to a score threshold, the monitor control unit determines whether the received data matches the predictive model. The monitor control unit may identify the events or pattern of events within the sensor data and the usage data, and compares the identified events or pattern of events to the expectations based on the predictive model.

The monitor control unit determines a likely current occupancy level of the property based on applying the current usage data and the current sensor data to the predictive model (480). The monitor control unit analyzes the received usage data and the sensor data to determine whether the property is occupied by at least one resident, or to determine whether the property is unoccupied. The monitor control unit determines that the likely current occupancy level of the property is unexpected (490). For example, the monitor control unit determines that the property is vacant when the property is expected to be occupied.

The monitor control unit performs an action in response to determining that the likely current occupancy level of the property is unexpected (500). The monitor control unit may generate a notification and provide the notification to the user device of a resident of the property. For example, the monitor control unit may determine that the property is vacant when the property is expected to be occupied, and may send an in-application message indicating that the home is not occupied. The notification may indicate to the resident that an occupancy simulation will be performed at the property. The occupancy simulation may mimic the human activity that typically occurs at the property when occupied at that particular time.

In some implementations, the monitor control unit determines that the monitoring system at the monitored property is in an unarmed state. The monitor control unit then provides an instruction to a subset of the one or more of the connected electronic devices to perform a series of actions that simulate occupancy at the property. For example, a series of lights within the property may switch on and off in a particular sequence, followed by the television switching on for thirty minutes. In some implementations, the resident may set preferences for the one or more connected electronic devices that should be included in the occupancy simulations at the property. For example, the resident may access the monitoring system application on their user device to indicate preferences for devices that should and should not be included in an occupancy simulation. For example, the user may select one or more lights in the kitchen, hall way, and bedroom to be included, and select that the PlayStation and the television should not be included. In some implementations, when the monitoring system at the monitored property is in an armed away state, the monitor control unit provides instruction to a second subset of the one or more connected electronic devices. The second subset of the one or more connected electronic devices may be different from the first subset of devices.

In some implementations, the monitor control unit is configured to train the predictive model that is configured to determine a likely given occupancy level of the property. The monitor control unit may train the predictive model based on additional sensor data and usage data. The monitor control unit may be configured to continuously aggregate data received, and update the predictive model based on the aggregated data. The monitor control unit may also receive feedback data from the resident, and use the feedback data to update the predictive model.

In some implementations, the resident may select an energy efficient option through the monitoring system application. When the energy efficient option is selected, the monitor control unit is configured to perform a series of actions that is estimated to use an energy level that is below a threshold. The monitor control unit may determine to perform a series of actions, and determine the expected energy consumption for performing the series of actions. The monitor control unit then compares the expected energy consumption for performing the series of actions to the threshold. When the expected energy consumption for performing the series of actions is above the threshold, the monitor control unit does not perform the series of action. The monitor control unit may then perform a series of actions that the expected energy consumption is lower than the threshold. In some implementations, the monitor control unit performs the series of actions that has the lowest energy consumption.

In some implementations, the resident may set preferences to perform occupancy simulations on a timing schedule. The resident may identify specific times that a series of actions should be initiated. For example, the resident may set preferences to perform occupancy simulations between 3:00 PM and 6:00 PM on Mondays. The monitor control unit may be configured to end the series of actions when the property is determined to be occupied. For example, when the contact sensor at the front door determines the front door is opened, the monitor control unit ends the series of actions.

In some implementations, the monitoring control unit is configured to train the predictive model based on sensor data and usage data associated with the specific property. In these examples, the monitor control unit receives the data from the property and aggregates the data over time and constantly retrains the data based on additionally received sensor and usage data. In other implementations, the monitor control unit is configured to train the predicted model based on sensor data and usage data associated with a neighboring property. For example, the monitor control unit may receive data from an external server that is in communication with the monitoring systems of neighboring homes. In these examples, the sensor data and usage data received from the one or more neighboring homes is communicated to the monitor control unit, and used to train the predictive model. Neighboring homes may include homes within a neighborhood, or homes within a particular zip code, or homes within a particular county, or any other zone. In another implementation, the monitor control unit is configured to train the predicted model based on sensor data and usage data associated with another property with a similar characteristic. For example, the monitor control unit may receive data from homes with a similar number of bedrooms or a similar number of residents.

In some implementations, the monitor control unit may determine that the property is occupied when the property is expected to be vacant. In these implementations, when the property is expected to be vacant and is determined to be occupied, the monitor control unit may deactivate the one or more indoor sensors, or indoor cameras. The monitor control unit may communicate a notification to the resident's user device indicating that an occupancy simulation will not be performed since the property is occupied.

The described systems, methods, and techniques may be implemented in digital electronic circuitry, computer hardware, firmware, software, or in combinations of these elements. Apparatus implementing these techniques may include appropriate input and output devices, a computer processor, and a computer program product tangibly embodied in a machine-readable storage device for execution by a programmable processor. A process implementing these techniques may be performed by a programmable processor executing a program of instructions to perform desired functions by operating on input data and generating appropriate output. The techniques may be implemented in one or more computer programs that are executable on a programmable system including at least one programmable processor coupled to receive data and instructions from, and to transmit data and instructions to, a data storage system, at least one input device, and at least one output device. Each computer program may be implemented in a high-level procedural or object-oriented programming language, or in assembly or machine language if desired; and in any case, the language may be a compiled or interpreted language. Suitable processors include, by way of example, both general and special purpose microprocessors. Generally, a processor will receive instructions and data from a read-only memory and/or a random access memory. Storage devices suitable for tangibly embodying computer program instructions and data include all forms of non-volatile memory, including by way of example semiconductor memory devices, such as Erasable Programmable Read-Only Memory (EPROM), Electrically Erasable Programmable Read-Only Memory (EEPROM), and flash memory devices; magnetic disks such as internal hard disks and removable disks; magneto-optical disks; and Compact Disc Read-Only Memory (CD-ROM). Any of the foregoing may be supplemented by, or incorporated in, specially-designed ASICs (application-specific integrated circuits).

It will be understood that various modifications may be made. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

The invention claimed is:

1. A monitoring system that is configured to monitor a property, the monitoring system comprising:

a sensor that is located at the property and that generates sensor data that reflects an attribute of the property;

a connected electronic device that is located at the property and that generates connected electronic device data that reflects a status of the connected electronic device; and a monitor control unit that stores instructions that are operable, when executed by the monitor control unit, to cause the monitor control unit to perform operations comprising:

receiving, from the sensor, the sensor data;

receiving, from the connected electronic device, the connected electronic device data;

based on the sensor data and the connected electronic device data, generating a model that predicts an occupancy state of the property;

receiving, from a user device of a resident of the property, one or more preferences for initializing an occupancy simulation at the property;

determining (i) a current occupancy state of the property based on the generated model, and that (ii) at least one of the one or more preferences for initializing an occupancy simulation at the property is met;

based on determining (i) the current occupancy state of the property based on the generated model, and that (ii) at least one of the one or more preferences for initializing an occupancy simulation at the property is met, performing an occupancy simulation by performing a series of actions that simulate occupancy at the property;

receiving, from the sensor or the connected electronic device, additional sensor data or additional connected electronic device data;

based on providing the additional sensor data or the additional connected electronic device data as an input to the model, determining that the property is likely occupied; and based on determining that the property is likely occupied, ending the occupancy simulation at the property.

2. The system of claim 1, wherein the operations include:

receiving, from the sensor or the connected electronic device, additional sensor data or additional connected electronic device data by receiving motion sensor data from a motion sensor that is located near a front entrance of the property.

3. The system of claim 1, wherein the operations include:

receiving, from the user device of the resident of the property, the one or more preferences for initializing the occupancy simulation at the property by receiving, a time range for performing the occupancy simulation at the property, and a selection of the connected electronic device and one or more additional connected electronic devices to be used to perform actions during the occupancy simulation; and performing the series of actions that simulate occupancy at the property by providing an instruction to the connected electronic device and the one or more additional connected electronic devices to perform a series of actions.

4. The system of claim 1, the operations include:

determining an armed state of the monitoring system at the property; and based on determining the armed state of the monitoring system, determining whether to perform a first series of actions that simulate occupancy, or a second series of actions that simulate occupancy, wherein the first series of actions is performed by the connected electronic device and a first subset of one or more additional connected electronic devices, and wherein the second series of actions is performed by a second subset of one or more additional connected electronic devices.

5. The system of claim 1, wherein the operations include:

receiving, additional sensor data and additional connected electronic device data from an additional monitoring system that is configured to monitor an additional property; and based on receiving the additional sensor data and the additional connected electronic device data, updating the model that predicts an occupancy state of the monitored property.

6. The system of claim 5, wherein the operations include:

receiving the additional sensor data and the additional connected electronic device data by receiving the additional sensor data and the additional connected electronic device data from the additional monitoring system that is configured to monitor the additional property that is located in a same geographical location as the monitored property.

7. The system of claim 6, wherein the operations include:

receiving the additional sensor data and the additional connected electronic device data by receiving the additional sensor data and the additional connected electronic device data from the additional monitoring system that is configured to monitor the additional property that is located in a same neighborhood as the monitored property.

8. The system of claim 6, wherein the operations include:

receiving the additional sensor data and the additional connected electronic device data by receiving the additional sensor data and the additional connected electronic device data from the additional monitoring system that is configured to monitor the additional property with a same number of residents as the monitored property.

9. The system of claim 1, wherein the operations include:

determining an armed state of the monitoring system at the property; and based on determining the armed state of the monitoring system, determining whether to perform a first series of actions that simulate occupancy, or a second series of actions that simulate occupancy, wherein the first series of actions is performed by the connected electronic device and a first subset of one or more connected electronic devices, and wherein the second serious of actions is performed by a second subset of one or more connected electronic devices.

10. The system of claim 9, wherein the operations include:

determining the armed state of the monitoring system at the property by determining that the armed state is armed away;

based on determining that the armed state is armed away, determining to perform the first series of actions that simulate occupancy at the property;

instructing the connected electronic device and the first subset of the one or more connected electronic devices to perform the first series of actions that simulate occupancy at the property;

after performing the first series of actions that simulate occupancy at the property, determining that the occupancy state of the property is vacant based on determining that the occupancy state of the property is vacant, instructing the first subset of the one or more connected electronic devices to perform a third series of actions that simulate occupancy at the property, wherein the first series of actions and the third series of actions are different;

receiving a disarm code to disarm the monitoring system; and based on receiving the disarm code, disarming the monitoring system and end the second series of actions that simulate occupancy at the property.

11. The system of claim 10, wherein the monitor control determines that the occupancy state of the property is vacant by:

determining an occupancy level score;

comparing the occupancy level score to an occupancy level threshold; and determining that the occupancy level score does not meet the occupancy level threshold.

12. The system of claim 9, wherein the operations include:

instructing the connected electronic device and the first subset of one or more electronic devices to perform the third series of actions that simulate occupancy at the property based on determining that an expected energy level usage for performing the third series of actions that simulate occupancy at the property is less than an expected energy level usage for performing a fourth series of actions that simulate occupancy at the property.

13. A computer-implemented method comprising:

receiving, by a monitoring system that is configured to monitor a property and from a sensor that is located at the property, sensor data that reflects an attribute of the property;

receiving, by the monitoring system and from a connected electronic device that is located at the property, connected electronic device data that reflects a status of the connected electronic device;

based on the sensor data and the connected electronic device data, generating, by the monitoring system, a model that predicts an occupancy state of the property;

receiving, by the monitoring and from a user device of a resident of the property, one or more preferences for initializing an occupancy simulation at the property;

determining, by the monitoring system, (i) a current occupancy state of the property based on the generated model, and that (ii) at least one of the one or more preferences for initializing an occupancy simulation at the property is met;

based on determining (i) the current occupancy state of the property based on the generated model, and that (ii) at least one of the one or more preferences for initializing an occupancy simulation at the property is met, performing, by the monitoring system, an occupancy simulation by performing a series of actions that simulate occupancy at the property;

receiving, by the monitoring system and from the sensor or the connected electronic device, additional sensor data or additional connected electronic device data;

based on providing the additional sensor data or the additional connected electronic device data as an input to the model, determining, by the monitoring system, that the property is likely occupied; and based on determining that the property is likely occupied, ending, by the monitoring system, the occupancy simulation at the property.

14. The method of claim 13, comprising:

receiving, by the monitoring system and from the sensor or the connected electronic device, additional sensor data or additional connected electronic device data by receiving motion sensor data from a motion sensor that is located near a front entrance of the property.

15. The method of claim 13, comprising:

receiving, by the monitoring system and from a user device of a resident of the property, the one or more preferences for initializing an occupancy simulation at the property by receiving, a time range for performing the occupancy simulation at the property, and a selection of the connected electronic device and one or more additional connected electronic devices to be used to perform actions during the occupancy simulation; and performing, by the monitoring system, the series of actions that simulate occupancy at the property by providing an instruction to the connected electronic device and the one or more additional connected electronic devices to perform a series of actions.

16. The method of claim 13, comprising:

determining, by the monitoring system, an armed state of the monitoring system at the property; and based on determining the armed state of the monitoring system, determining by the monitoring system, whether to perform a first series of actions that simulate occupancy, or a second series of actions that simulate occupancy, wherein the first series of actions is performed by the connected electronic device and a first subset of one or more additional connected electronic devices, and wherein the second series of actions is performed by a second subset of one or more additional connected electronic devices.

17. The method of claim 13, comprising:

receiving, by the monitoring system, additional sensor data and additional connected electronic device data from an additional monitoring system that is configured to monitor an additional property; and based on receiving the additional sensor data and the additional connected electronic device data, updating, by the monitoring system, the model that predicts an occupancy state of the monitored property.

18. The method of claim 17, comprising:

receiving, by the monitoring system, the additional sensor data and the additional connected electronic device data by receiving the additional sensor data and the additional connected electronic device data from the additional monitoring system that is configured to monitor the additional property that is located in a same geographical location as the monitored property.

19. The method of claim 17, comprising:

receiving, by the monitoring system, the additional sensor data and the additional connected electronic device data by receiving the additional sensor data and the additional connected electronic device data from the additional monitoring system that is configured to monitor the additional property that is located in a same neighborhood as the monitored property.

20. The method of claim 13, comprising:

determining, by the monitoring system, an armed state of the monitoring system at the property; and based on determining the armed state of the monitoring system, determining, by the monitoring system, whether to perform a first series of actions that simulate occupancy, or a second series of actions that simulate occupancy, wherein the first series of actions is performed by the connected electronic device and a first subset of one or more connected electronic devices, and wherein the second serious of actions is performed by a second subset of one or more connected electronic devices.

* * * * *